United States Patent [19]

Thorne-Booth

[11] 4,269,415

[45] May 26, 1981

[54] SCORING SYSTEM FOR SHOOTING GALLERY

[76] Inventor: George M. Thorne-Booth, 4614 Sendero Pl., Tarzana, Calif. 91356

[21] Appl. No.: 29,641

[22] Filed: Apr. 13, 1979

[51] Int. Cl.[3] ..... F41J 5/02

[52] U.S. Cl. ..... 273/310

[58] Field of Search ..... 273/310, 311, 312

[56] References Cited

U.S. PATENT DOCUMENTS

| | | | |
|---|---|---|---|
| 2,269,258 | 1/1942 | Falkenberg | 273/312 |
| 4,192,507 | 3/1980 | Rains et al. | 273/311 |

FOREIGN PATENT DOCUMENTS

| | | | |
|---|---|---|---|
| 2829661 | 2/1979 | Fed. Rep. of Germany | 273/311 |

*Primary Examiner*—Anton O. Oechsle

*Attorney, Agent, or Firm*—Smyth, Pavitt, Siegemund & Martella

[57] ABSTRACT

An electronic system especially advantageous for use in a shooting gallery of the type in which the guns project beams of light instead of bullets employs an electronically gated target polling systems to enable each fired gun to be credited unambiguously with a score based on which target, if any, is struck by the gun fired. All the photosensors on the targets are polled during a particular very short time interval after any of the guns has been triggered; extraneous light occurring at other times is not registered. When a gun is fired, the system initiates generation of cosmetic action such as recoil, simulated explosion, and ricochet sound, and the system decrements a rounds remaining counter. When a target hit is registered, the system initiates target effects, and increments a score counter associated with the gun fired by a target-dependent amount. A large number of guns and targets can be accommodated.

21 Claims, 7 Drawing Figures

TARGET SENSORS
t1
t2
t3
t4
26
28
30
TARGET IDENTIFYING CIRCUIT
35
GALLERY PHENOMENA ACTUATOR
32
FIRE SIGNAL
22
37
AMMUNITION COUNTERS
34
SCORE COUNTERS
FIRE SIGNAL GENERATOR
10
24
GUN FIRING CIRCUIT
G3
G2
G1
12
GUNS
18
16
GUN IDENTIFYING CIRCUIT
20
TRIGGER SIGNALS
COSMETIC EFFECTS GENERATOR
COSMETIC EFFECTS GENERATOR
COSMETIC EFFECTS GENERATOR
TR1
TR2
TR3
14
TRIGGER SWITCHES

SET i=1
EXAMINE GUN Gi
52
IS Gi TRIGGERED ?
YES
56
54
NO
STORE i
? i = N
YES
GENERATE FIRE SIGNAL
NO
i+1→i
DECREMENT SHOTS REMAINING IN Gi
DELAY 1500μs
i+1→i
SET j=1
TERMINATE FIRE SIGNAL
EXAMINE TARGET tj
tj STRUCK ?
YES
ACTUATE tj EFFECTS
RECALL i AND AUGMENT SCORE OF Gi BASED ON tj
NO
? j = m
YES
NO
j+1→j

SCORING SYSTEM FOR SHOOTING GALLERY

BACKGROUND OF THE INVENTION

1. Field of the Invention

The present invention is in the field of amusement and specifically relates to a system for use in a shooting gallery for determining which target has been struck when a particular gun is fired.

2. The Prior Art

For safety purposes it has been customary to use optical bullets in shooting galleries used for entertainment in which the activation of the trigger causes the emission of a flash of light (or other electromagnetic radiation) concentrated into a narrow beam by a combination of lenses. This narrow beam is substantially coaxial with the barrel and sighting marks of the rifle.

Photosensors are placed at indicated target positions which are activated by an incident beam of light, causing actuation of any of a number of phenomena which are required by the design of the gallery e.g. a mounted rider falls over—a piano player starts to operate—an alligator opens its mouth—lights flash etc. The variety of these phenomena are limited only by the imagination of the gallery designer.

It is customary to use a number of rifles at a counter, in order to accommodate several customers simultaneously.

There are two serious disadvantages to this prior art which the present invention corrects: (1) when two or more guns are fired substantially simultaneously, the allocation of struck targets to fired guns is plagued with ambiguity; and, (2) the exposure of a camera flashlight, or similar intense source of broad radiation can cause simultaneous activation of all photosensors which the flash of light irradiates, thereby actuating all of the phenomena of the gallery simultaneously and reducing the value of the gallery.

SUMMARY OF THE INVENTION

The present invention overcomes these disadvantages of the prior art systems by delaying the firing of the bullet subsequent to actuation of the trigger in a controlled manner in order to prevent the simultaneous firing of two or more guns, and examining all the targets during or immediately after the firing of the identified gun to identify which target or targets, if any, have been struck.

The method of identification proposed in this invention is that of associating an identified time slot with the firing of the optical bullet. The timing of the identified time slot can be fixed within a chosen sequence of time slots, or its timing can be determined in accordance with a chosen priority scheme. The optical bullet is fired during this allocated time slot, subsequent to the actual pulling of the trigger: during this time slot the outputs of all the targets are examined sequentially or simultaneously. If the marksman has successfully aimed at a photosensor target, then the correct target is identified during the target examination and the fired gun is identified by its unique time slot. Therefore a score can be allocated uniquely to the gun fired. The determination of the value of the score is dependent upon the wishes of the gallery operator—it could be fixed (as indicated by a painted number, or the appropriate annular ring of a traditional bullseye target) or it can be variable (as indicated by a changing display, e.g. LED digit, LCD digit, or magnetically operated digit located in the close vicinity of the appropriate target).

The system of the present invention is fundamentally resistant to activation by photo-flash because the targets are only examined for photo-sensor response during about 1 millisecond subsequent to each "trigger-pull"; and even if a photo-flash is fired during the critical period, the recognition of more than one simultaneously struck target can be used as information to inhibit the allocation of a score and to allow credit as "unfired gun" to the marksman.

In order to further increase this fundamental insensitivity to photo-flash, and to improve the tolerances of operation in varying ambient light conditions the pulse of electromagnetic radiation which is emitted to simulate a bullet can be additionally modulated in some way to provide a more unique signature e.g. amplitude modulated at 20 KHZ.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
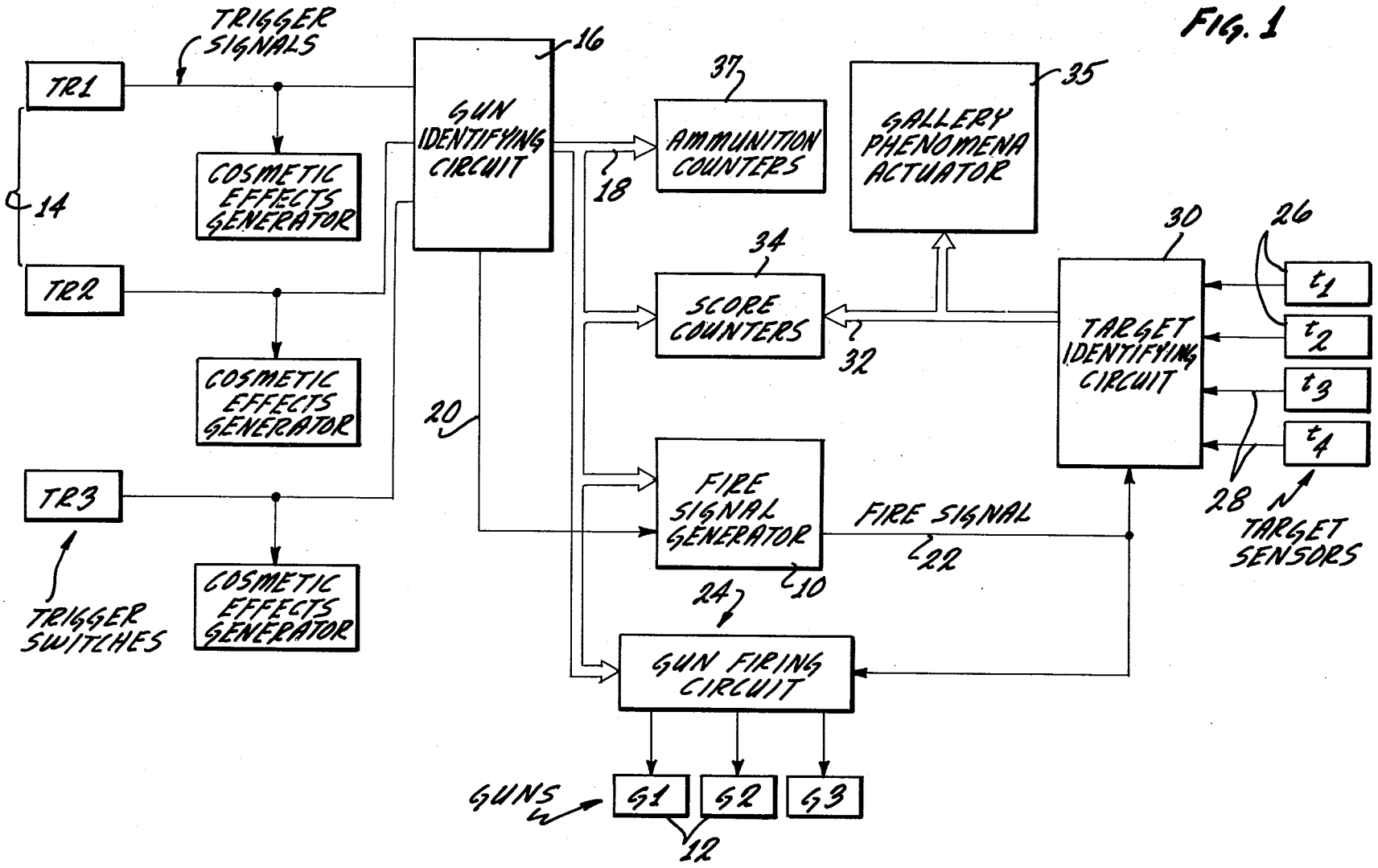
FIG. 1 is a block diagram of a preferred embodiment of the present invention.

Turning now to the drawings in which like parts are denoted by the same reference numerals, there is shown in FIG. 1 a block diagram of a preferred embodiment of the present invention. Each of the guns 12 includes one of the trigger switches 14 coupled to the trigger of the gun so that when the operator actuates the trigger of the gun, the state of the associated trigger switch is altered, producing a trigger signal. The trigger signals are applied to the cosmetic effects generators 15 which are located in the guns and produce effects simulative of a firing. The trigger signals from the trigger switches 14 are fed to a gun identifying circuit 16, which produces an electrical output on the bus 18 indicative of which gun was triggered. In an alternative embodiment, the gun identifying circuit 16 includes a sequential gun sampling circuit which polls the guns in sequence to determine which has been triggered.

In a preferred embodiment, the individual trigger signals are ORed within the gun identifying circuit 16 to produce a signal on the line 20 each time any one of the guns 12 has been triggered. In the present invention, a distinction is made between the triggering of one of the guns and the firing of that gun. The signals on the line 20 are applied to the FIRE signal generator 10 which eventually produces a FIRE signal on the line 22.

In a preferred embodiment of the present invention, the FIRE signal generator 10 includes a cyclical sequencing switch comparable in operation to the distributor of an automobile engine, which postpones production of the FIRE signal on the line 22 until the cyclical sequential switch has advanced to a position associated with the gun that was triggered. At that time, the FIRE signal of a predetermined duration is generated. This mode of operation is illustrated in the timing diagram of FIG. 2. The FIRE signal on the line 22 and the signal on the bus 18 representing the identity of the gun that was triggered are fed to the gun firing circuit 24 which fires the gun that was previously triggered at a later time coincident with the start of the FIRE signal. In a preferred embodiment, the firing of one of the guns 12 includes the generation of a pulse of light or other electromagnetic radiation from the gun. The light is formed into a beam which is directed in the direction to which the gun is pointed. Each of the targets is provided with one or more target sensors 26. The target sensors, when struck by the light beam, respond by producing an electrical signal, and these signals are fed on lines 28 to the target identifying circuit 30.

In a preferred embodiment, the target identifying circuit 30 includes a sequential switch which polls the target sensors in succession, the polling sequence being initiated by the FIRE signal on the line 22. The entire target sensor sampling sequence is completed within the duration of the FIRE signal, and the sequential sampling switch is reset when the struck target has been identified, or alternatively when the last target has been examined. The target identifying circuit 30 produces a signal on the bus 32 representing the identity of the struck target, if any are struck.

The identity of the struck target, represented by the signal on the bus 32 determines the score, while the identity of the gun triggered, represented by the signal on the bus 18 determines to which of the guns the score will be attributed. The score counter 34 includes a number of counters on which the accumulated scores are maintained. The signal on the bus 32 is also applied, in a preferred embodiment, to the gallery phenomena actuator 35 which produces target effects which may be mechanical, audible, or optical. The signal on the bus 18 is applied to the rounds counters 37, which tell the rounds used and/or rounds remaining for each of the guns.

In the preferred embodiment, the gun identifying circuit 16 includes a trigger signal holding circuit, which could be implemented with flip flops and which holds a trigger signal until the signal can be acted on. When a particular trigger signal has been acted on it is deleted from the trigger signal holding circuit.

In a preferred embodiment the gun identifying circuit 16 can poll the trigger switches at the rate of one switch every 20 microseconds; sixteen trigger switches can be sampled in 0.32 milliseconds. In a preferred embodiment, the incoming triggered signals are stored in a first-in-first-out storage, and if a second trigger signal should arrive within 2.50 milliseconds of a previous trigger signal, the latter trigger signal is stored for detection on a subsequent cycle of the gun sequential polling circuit of the gun identifying circuit 16.

Figure 3:
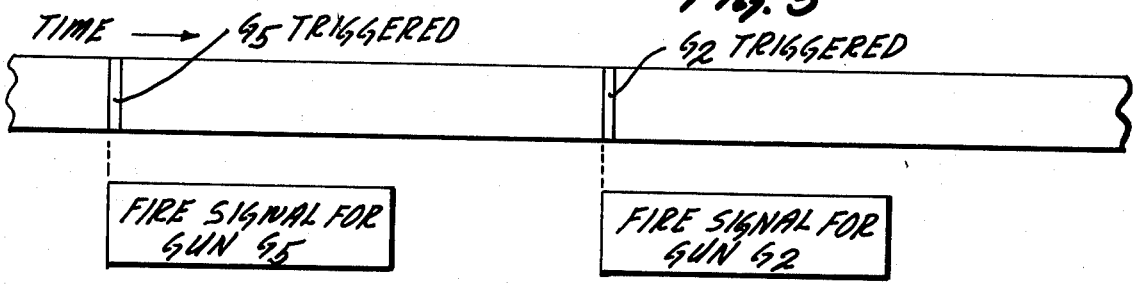
FIG. 3 is a timing diagram illustrating the sequence of operations in an alternative embodiment.
Figure 4:
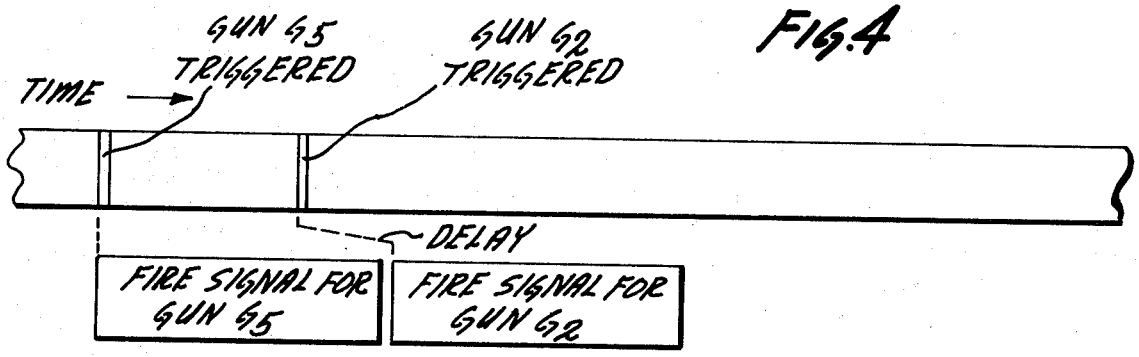
FIG. 4 is a timing diagram illustrating the sequence of operations in an alternative embodiment when a second gun is fired immediately after a first gun has been fired.

In an alternative embodiment, the cyclical sequential sampling of the guns is dispensed with and instead, as shown in FIG. 3, the guns are identified at the time they are triggered and firing signals are generated immediately afterwards. In this embodiment, as shown in FIG. 4, if a second gun is triggered during the existence of the FIRE signal of a previous gun, the FIRE signal of the latter-triggered gun is delayed to permit completion of the on-going sequence of operations associated with the first gun fired.

Figure 2:
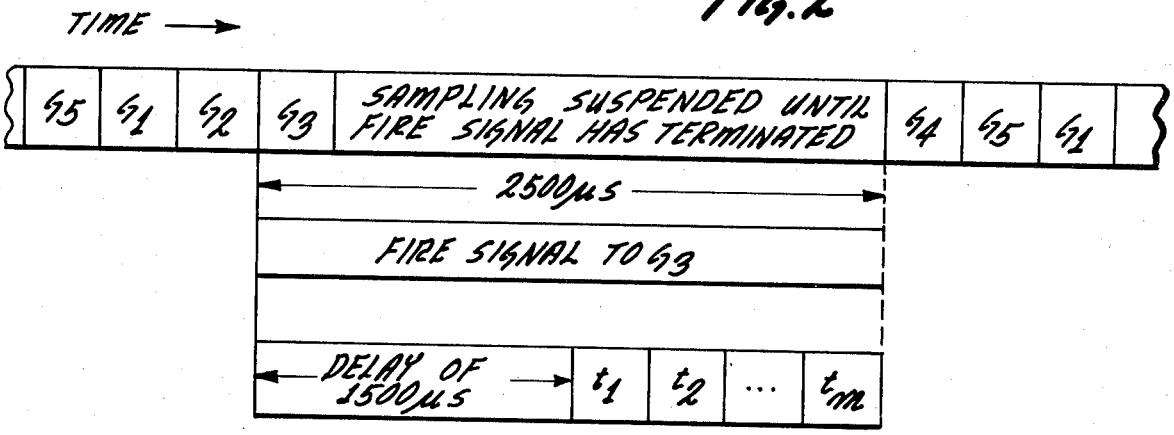
FIG. 2 is a timing diagram illustrating the sequence of operations in a preferred embodiment.

In all embodiments, the target struck is associated with the gun that produced the strike by the use of a FIRE signal associated with a single one of the guns and during which FIRE signal the targets are examined. This is illustrated in FIG. 2 wherein following the triggering of the gun $G_3$ a FIRE signal of 2500 microseconds duration is generated and during the duration of the FIRE signal, each of the target sensors $t_1$–$t_9$ are polled. In one of the embodiments, if one of the targets indicates a strike, such as $t_7$ in the example of FIG. 2, the FIRE signal is terminated immediately and the sampling of the guns is resumed. In another embodiment, the FIRE signal persists until all of the targets have been sampled, to ensure that only one target has been struck; if more than one target has been struck, the signals on the buses 18, 32 are inhibited, nullifying the firing. As shown in FIG. 2, in the preferred embodiment, a delay of 1500 microseconds is provided after the initiation of the FIRE signal prior to initiation of the target sampling sequence. This 1500 microsecond delay provides adequate time for the struck target sensors to produce an electrical output.

Figure 5:
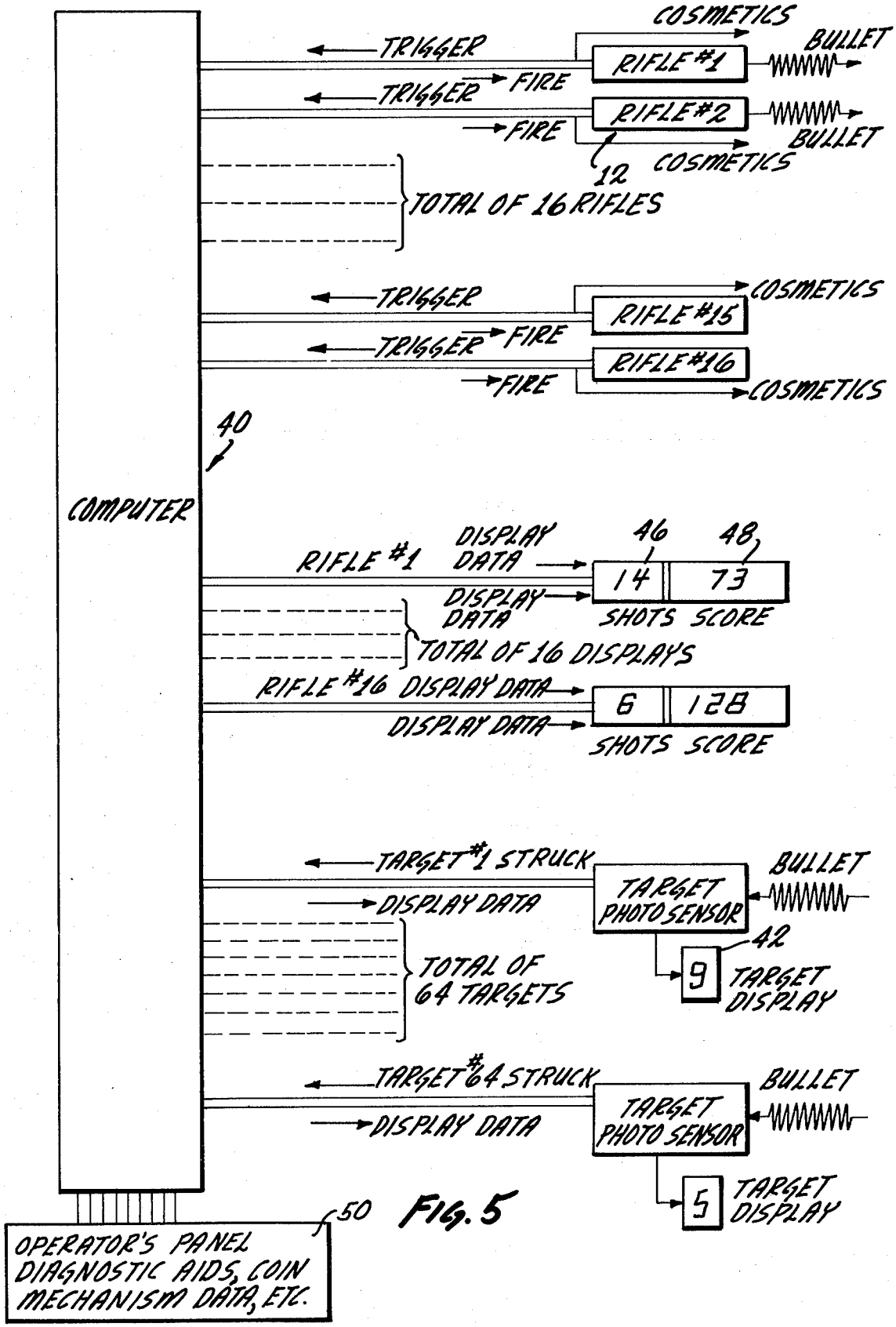
FIG. 5 is a block diagram of the system of the present invention as implemented by use of a central processor.

As shown in FIG. 5, the system of the present invention may also be implemented by the use of a computer 40 at the top part of FIG. 5, it is seen that the guns 12 are connected to the computer 40 by lines on which the TRIGGER signals and the FIRE signals are conducted. As indicated, when fired, the guns produce pulses of radiant energy, and cause cosmetic effects such as recoil, simulated explosion, and ricochet sound to be generated.

As shown at the bottom of FIG. 5, the target sensors 26 are also connected to the computer, and the target includes a target display 42, a mechanical actuator 44 for producing special effects when the target has been struck. As indicated, it would not be unusual to have 64 targets.

As indicated in the middle of FIG. 5, a rounds counter 46 and a score counter 48 are associated with each rifle and are connected to the computer 40. The computer 40 further includes an operator's panel 50 which displays diagnostic aids and coin mechanism data.

Figure 6:
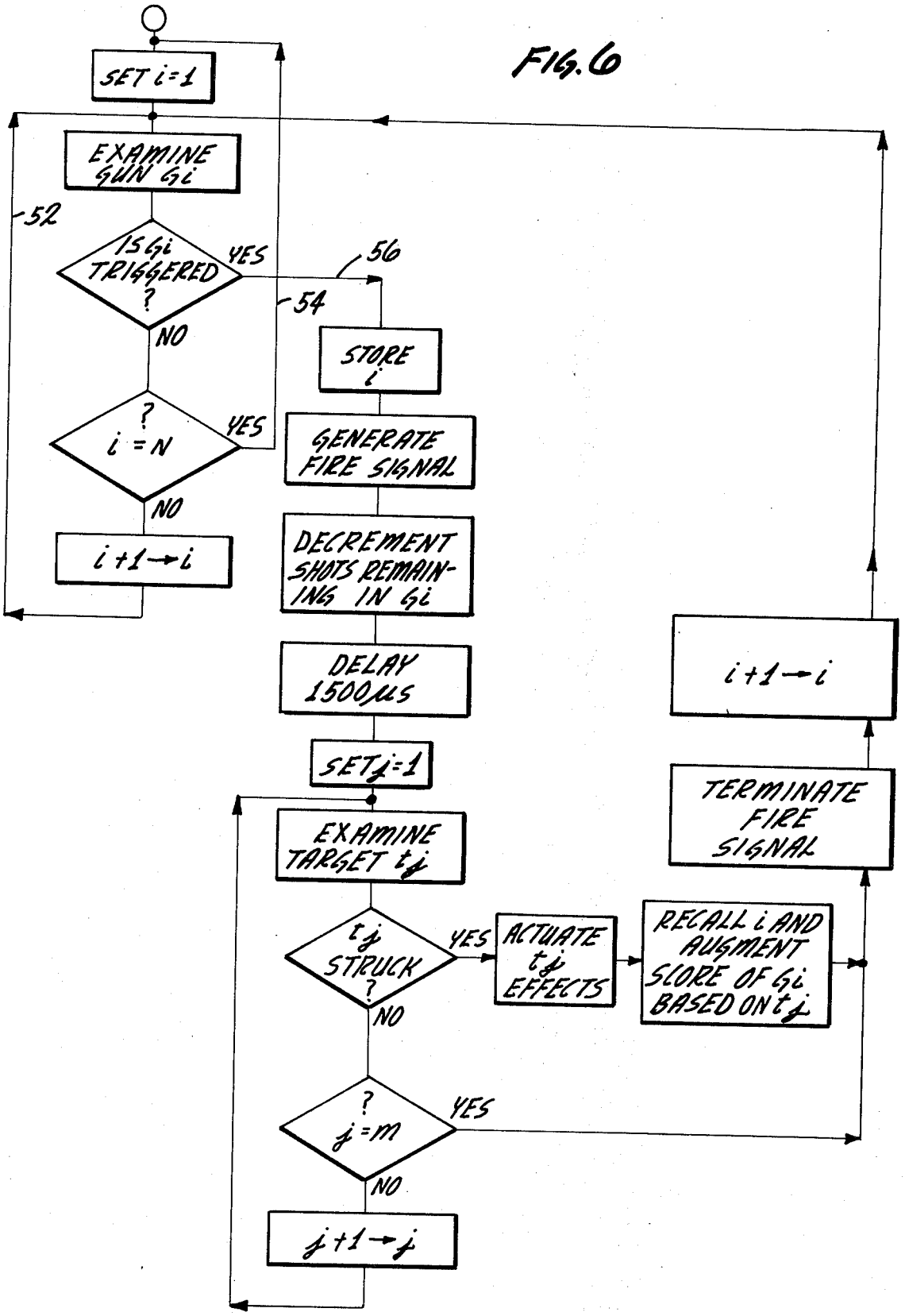
FIG. 6 is a flow chart embodying the preferred embodiment of the present invention in a form suitable for use with a computer.

FIG. 6 is a flow chart describing the method in a preferred embodiment of the present invention, and which would be suitable for controlling the operation of the computer of FIG. 5 to implement the method. It is seen that until one of the guns has been triggered, the polling sequence is repeated through the loops 52,54. Upon one of the guns being triggered, the chart branches via the line 56 to generate the FIRE signal, to decrement the number of rounds remaining in the gun fired, to provide for the 1500 microsecond delay, and finally, to initiate the sequential target polling operation. In one embodiment, the FIRE signal is terminated when the struck target has been identified, or if no target has been struck, when all the target sensors have been sampled. In another embodiment, the FIRE signal persists until all of the target sensors have been sampled.

Figure 7:
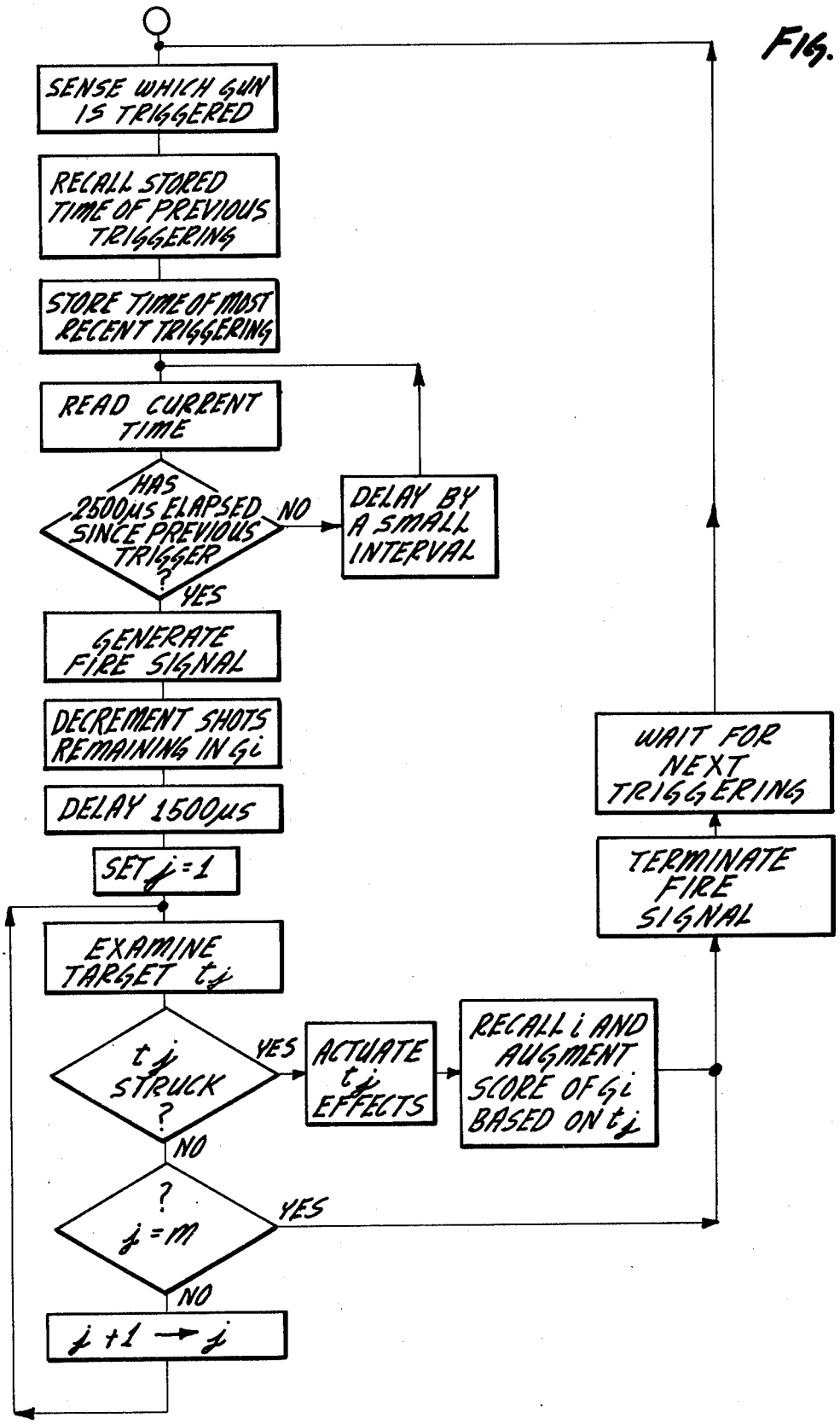
FIG. 7 is a flow chart embodying an alternative embodiment of the present invention in a form suitable for use with a computer.

FIG. 7 is a flow chart, similar to that of FIG. 6 but implementing the alternative embodiment of the present invention wherein the sequential sampling of the guns is dispensed with and wherein initiation of a second FIRE signal is postponed until an existing FIRE signal has been terminated.

Notwithstanding that several particular embodiments have been described in detail to exemplify the invention, it will be recognized by those skilled in the art that numerous alternative embodiments are conceivable.

Thus, in one embodiment, the guns are polled continually to determine whether one of them has been triggered. Alternatively, the trigger signal leads may be ORed to provide a signal to initiate a polling only after one of the guns has been triggered.

In a preferred embodiment, the guns and targets are sampled in a predetermined sequence. However, the sampling does not have to be sequential in time; in another embodiment, all of the guns or targets can be polled simultaneously. The input to the gun or target identifying circuits may be thought of as an electrical representation of a one-digit number of base N, where N is the number of guns or targets. The identifying circuits 16, 30 may then be regarded as devices which convert this single digit of base N to, say, a multiple digit binary number suitable for use in a microprocessor as a word of data or as an address. Converters of this type are well known in the art.

In a preferred embodiment, the gun sampling is interrupted for the duration of the FIRE signal and is resumed after the termination of the FIRE signal at the next gun following the triggered gun in the sampling sequence. It is recognized that in other embodiments the sampling can be resumed at the beginning of the sampling sequence or at some other point within the sequence.

In a preferred embodiment, the incoming trigger signals are stored in a first-in-first-out storage so that the trigger signals are acted upon in the same chronological order in which they arrive, albeit with some delay. Although this technique is eminently egalitarian, it is by no means the only possible approach. For example, when more than one trigger signal is in the storage, the next trigger signal to be acted upon may be chosen from among those in storage by use of any consistent priority scheme based on the identities of the stored trigger signals. For example, the lowest numbered gun may always be the first to be fired.

Thus, there has been described an electronic scoring system especially advantageous for use in a shooting gallery of the type in which the guns project beams of light instead of bullets. The system makes it possible to associate without ambiguity which of the guns produced a strike on a target. The particular utility of the invention in connection with shooting galleries does not limit the fields in which it may be exploited, and the application of the method of the present invention to scoring systems in which real bullets are fired would be relatively straightforward.

The foregoing detailed description illustrates several embodiments of the invention, and it is to be understood that additional embodiments thereof would be obvious to those skilled in the art. The embodiments described therein together with those additional embodiments are considered to be within the scope of the invention.

What is claimed is:

1. A scoring method for determining which one of several guns has been fired, and for determining which one, if any, of several targets has been struck by the fired gun, comprising the steps of:

sensing in chronological order the identities of successively triggered guns;

generating each time a gun is triggered a FIRE signal associated with the gun triggered, the FIRE signal having a preset duration and being initiated when the gun is triggered, unless the immediately preceeding FIRE signal is still present, in which case initiation of the later FIRE signal is delayed until termination of the earlier FIRE signal, the triggered gun being fired upon initiation of the later FIRE signal;

sampling the targets, starting the sampling a preset time after initiation of each FIRE signal and continuing until a struck target has been found or until all of the targets have been sampled;

sensing the identity of the struck target; and, associating the identity of the struck target with the identity of the gun associated with the current FIRE signal.

2. The method of claim 1 wherein during said preset time after initiation of each FIRE signal, the following step is included:

incrementing a rounds counter associated with the fired gun, said rounds counter maintaining a count of the cumulative number of times that gun has been fired.

3. The method of claim 1 wherein during said preset time after initiation of each FIRE signal the following step is included:

decrementing a rounds counter associated with the fired gun, said rounds counter maintaining a count of the number of firings remaining in that gun.

4. The method of claim 1 wherein after the identity of the struck target has been associated with the identity of the gun fired, the following step is included:

incrementing a score counter associated with the gun fired by an increment dependent on the identity of the target struck.

5. The method of claim 1 wherein the step of sensing the identity of the struck target further comprises:

sampling sequentially to poll the targets in sequence to determine which target has been struck.

6. The method of claim 1 wherein said FIRE signal is generated in response to a TRIGGER signal produced by the triggering of a gun.

7. The method of claim 6 wherein the operation of said gun sensing means is interrupted from the time a TRIGGER signal is sensed until the termination of the fire signal associated with the TRIGGER signal.

8. The method of claim 6 wherein the operation of said gun sensing means is interrupted from the time a TRIGGER signal is sensed until the time the struck target has been identified.

9. The method of claim 6 wherein the operation of said gun sensing means is interrupted from the time a TRIGGER signal is sensed until all of the targets have been polled.

10. The method of claim 1 or 5 wherein the step of sensing the identity of any target that is struck further comprises the step of:

sampling the targets, starting the sampling a preset time after initiation of the FIRE signal.

11. The method of claim 1 or 5 wherein the sampling of the targets is continued until all of the targets have been sampled.

12. The method of claim 1 or 5 further comprising the step of:

nullifying the firing when it is determined that more than one target has been struck.

13. The method of claim 1 or 5 wherein target effects are generated only if exactly one of the several targets is struck.

14. The method of claim 1 or 5 wherein the sampling of the targets is continued until a struck target has been sensed.

15. The method of claim 1 or 5 further comprising the step of:

terminating the sensing of struck targets upon sensing the identity of a struck target.

16. The method of claim 1 or 5 further comprising the step of:

terminating the FIRE signal upon sensing the identity of a struck target.

17. The method of claim 1 or 5 further comprising the steps of:

storing the identities of the triggered guns; and, recalling one at a time the stored identities of the triggered guns, prior to initiating a FIRE signal associated with each of the stored identities.

18. The method of claim 6 wherein when a second TRIGGER signal is generated within a time less than the preset duration of the FIRE signal after a first TRIGGER signal has been generated, said FIRE signal generating means postpones generation of the FIRE signal associated with the second TRIGGER signal until after termination of the FIRE signal associated with the first TRIGGER signal.

19. The method of claim 17 wherein the identities of the triggered guns are recalled in the chronological order in which the identities were sensed.

20. The method of claim 17 wherein the stored identities of the triggered guns are recalled in a different order than the chronological order in which the identities were sensed.

21. The method of claim 17 where the stored identities of the triggered guns are recalled in a order based on the stored identities.

* * * * *